US006675492B2

(12) United States Patent
Hsu

(10) Patent No.: US 6,675,492 B2
(45) Date of Patent: Jan. 13, 2004

(54) REGENERATIVE DEHUMIDIFIER

(76) Inventor: Tsang-Hung Hsu, 14 Floor, No. 632, Ta-Yu Road, Taoyuan City (TW)

( * ) Notice: Subject to any disclaimer, the term of this patent is extended or adjusted under 35 U.S.C. 154(b) by 16 days.

(21) Appl. No.: 10/011,805

(22) Filed: Nov. 27, 2001

(65) Prior Publication Data

US 2003/0097762 A1 May 29, 2003

(51) Int. Cl.[7] ..... F26B 3/00
(52) U.S. Cl. ..... 34/80; 34/73; 34/79; 34/235
(58) Field of Search ..... 34/218, 235, 72, 34/73, 79, 80

(56) References Cited

U.S. PATENT DOCUMENTS 4,269,611 A * 5/1981 Anderberg ..... 96/124
4,370,544 A * 1/1983 Fujishima et al. ..... 392/379
4,654,057 A * 3/1987 Rhodes ..... 96/127
5,301,439 A * 4/1994 Wang ..... 96/125
6,378,224 B1 * 4/2002 Qualkinbush et al. ..... 34/80

* cited by examiner

*Primary Examiner*—Ira S. Lazarus
*Assistant Examiner*—Kathryn S. O'Malley

(57) ABSTRACT

A regenerative dehumidifier includes: a housing having perforations formed through the housing for directing moisture-laden (or moisture-free) air therein (or therefrom), a moisture-absorbable dehydrating agent including silica gel filled in the housing for absorbing moisture as laden in the air entering the housing for dehumidification or dehydration, and a heating device sandwiched in a first layer and a second layer of the dehydrating agent disposed on opposite sides of the heating device for heating the moisture-saturated dehydrating agent for vaporizing water from the dehydrating agent in order for regenerating the water-absorbed dehydrating agent for its re-use.

1 Claim, 4 Drawing Sheets

REGENERATIVE DEHUMIDIFIER

BACKGROUND OF THE INVENTION

It is known that silica gel may be provided to absorb moisture for dehydration or dehumidifying purpose. However, reviewing conventional moisture extractor such as disclosed in U.S. Pat. No. 4,109,487 to General Motors Corporation, the silica gel after being saturated with moisture will be removed and replaced with new desiccant, thereby wasting the desiccant material and causing environmental protection problem.

If for regenerating the conventional dehydrator by heating the saturated silica gel, a heater and a forced-draft air fan should be provided to direct hot air through the moisture-impregnated silica gel in order to vaporize and remove the water as absorbed in the gel, thereby increasing installation cost and total volume of the dehydrator.

The present inventor has found the drawbacks of conventional dehydrator and invented the present regenerative dehumidifier.

SUMMARY OF THE INVENTION

The object of the present invention is to provide a regenerative dehumidifier including: a housing having perforations formed through the housing for directing moisture-laden (or moisture-free) air therein (or therefrom), a moisture-absorbable dehydrating agent including silica gel filled in the housing for absorbing moisture as laden in the air entering the housing for dehumidification or dehydration, a heating device sandwiched in a first layer and a second layer of the dehydrating agent disposed on opposite sides of the heating device for heating the moisture-saturated dehydrating agent for vaporizing water from the dehydrating agent in order for regenerating the water-absorbed dehydrating agent for its re-use; and a saturation indicator having the same dehydrating agent but further added with a color-change indicator therein to be provided on a cover of the housing and fluidically communicated with the dehydrating agent in the housing; whereby upon saturation of the dehydrating agent, the saturation indicator will show a color change of the dehydrating agent to remind the user of actuation of the heating device for regenerating the moisture-saturated dehydrating agent ready for next use.

DETAILED DESCRIPTION

Figure 1:
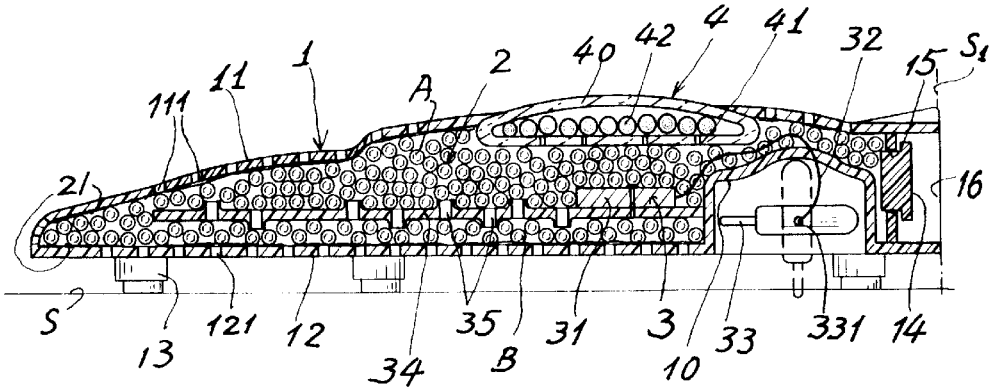
FIG. 1 is a sectional drawing of the present invention.
Figure 2:
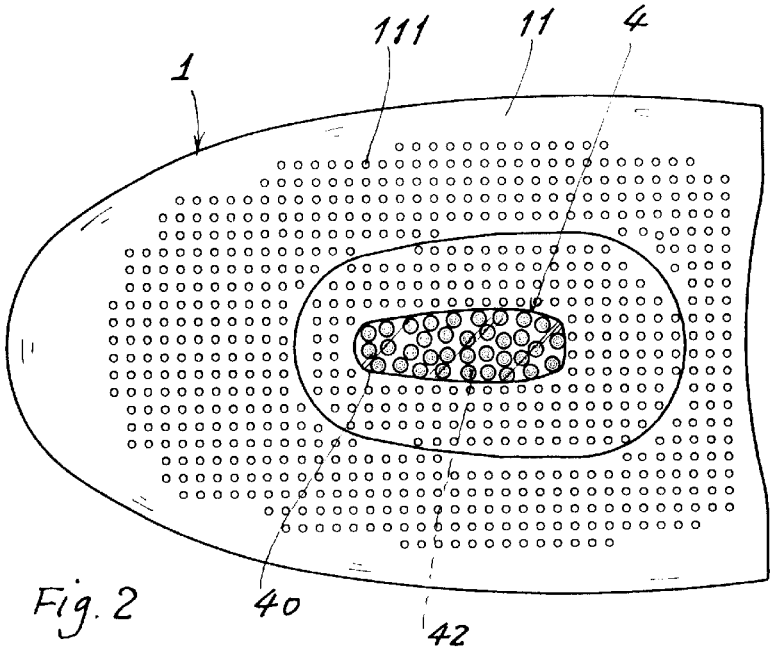
FIG. 2 is a top view of the present invention.
Figure 3:
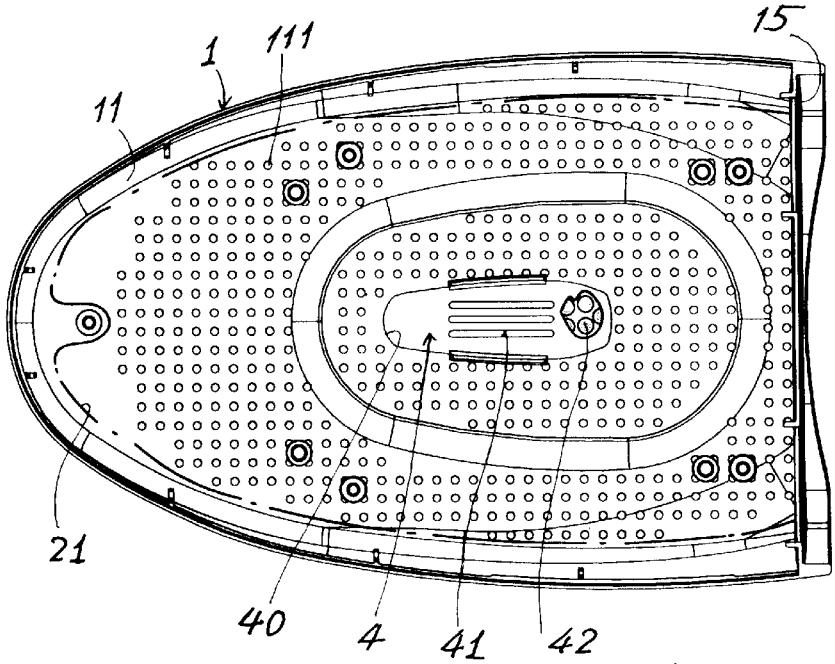
FIG. 3 is a bottom view of a first cover (or half shell) of the housing having the saturation indicator fixed thereon.
Figure 4:
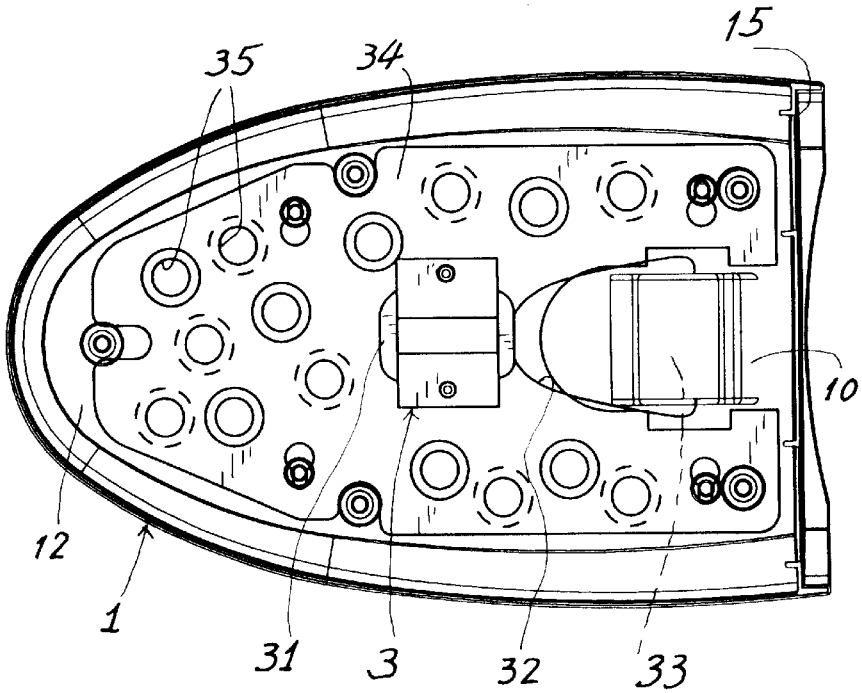
FIG. 4 is a plan view of the present invention showing the heating means secured on a second cover of the housing when removing the first cover.
Figure 5:
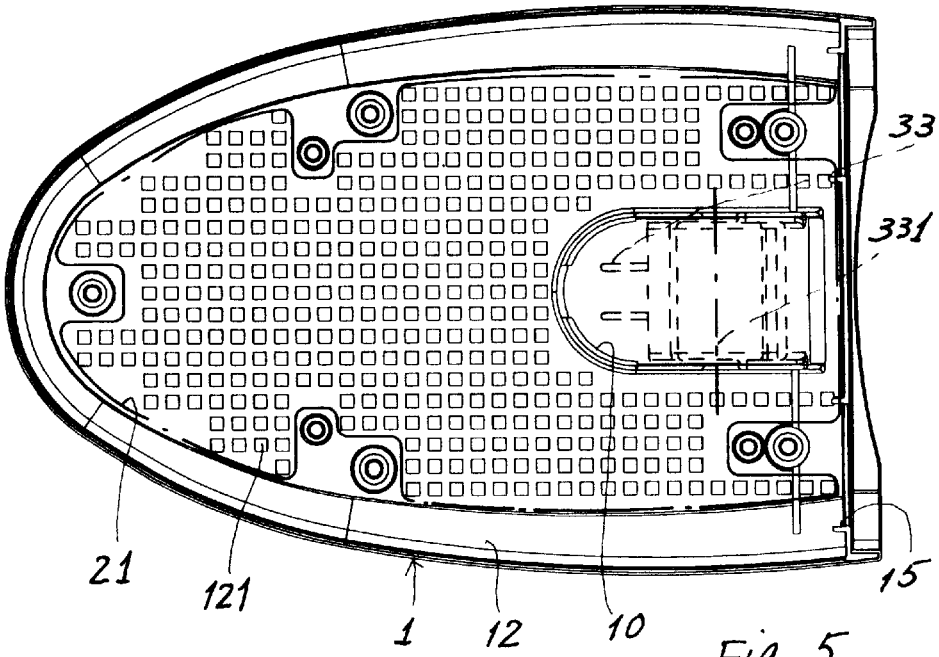
FIG. 5 is a plan view of the second cover when removing the heating means of the present invention.
Figure 6:
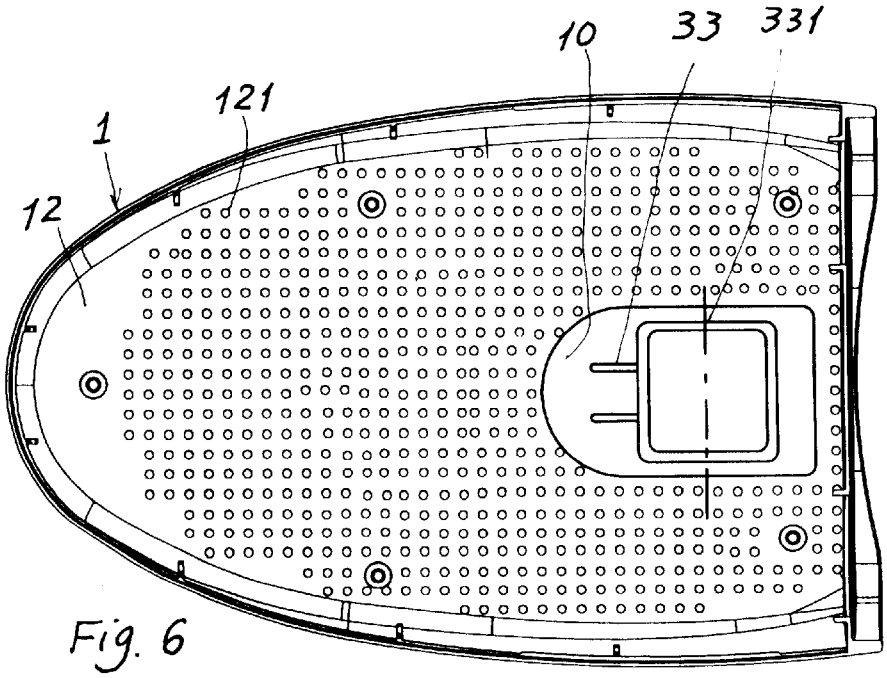
FIG. 6 is a bottom view of the present invention with round shape perforations as modified from FIG. 5.
Figure 7:
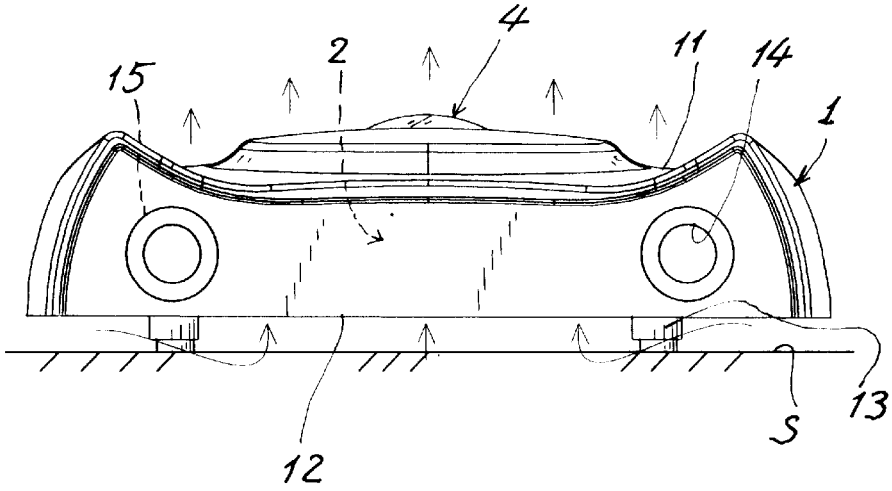
FIG. 7 is a right side view of the present invention.

As shown in the drawing figures, the present invention comprises: a housing 1, a dehydrating agent 2 filled in the housing 1, a heating means 3 formed in the housing 1 for heating and regenerating the dehydrating agent 2 once saturated with moisture, and a saturation indicator 4 secured to a cover of the housing 1 and fluidically communicated with an interior in the housing 1.

The housing 1 includes: a first cover (or first half shell) 11, a second cover (or second half shell) 12 combined with said first cover 11 for forming the housing 1 for filling the dehydrating agent 2 therein, a plurality of supporting pads 13 formed on the second cover 12, at least a plug (or two plugs) 14 plugged in a plug hole (or two plug holes) 15 formed in a side portion of the housing 1 for filling the dehydrating agent 2 into the interior of the housing through the plug hole 15. Both covers 11, 12 may be combined by riveting or by any other mechanical joining methods, or even the housing 1 may be integrally formed to be a container for filling the agent 2 therein and for accommodating the heating means 3 and saturation indicator 4 therein, not limited in this invention.

Each cover 11 or 12 is drilled or formed with a plurality of perforations 111 or 121 for ventilation purpose. To an inner side surface of either cover 11 or 12, a filter sheet (a filter cloth or paper which is air permeable through the filter) 21 is attached to each cover 11 or 12 to preclude an outward releasing or discharge of the dehydrating agent 2 which may be formed as granules or powder through the perforations 111, 121 formed through the covers 11, 12; but to allow air or moisture-laden air flowing through such an air-permeable filter sheet 21 attached to the inside surface of either cover 11 or 12 of the housing 1.

The dehydrating agent 2 may be selected from silica gel granules or any other water-absorbable materials. After being saturated with moisture in the dehydrating agent, heat may be applied to vaporize the moisture from the agent 2 so that upon removal of water from the agent 2, the dehydrating agent 2 is regenerated ready for next dehydration or dehumidification.

The heating means 3 includes: a PTC (positive-temperature-coefficient semiconductors) heater or heater 31 electrically connected by two wires 32 to an electric plug 33 connected to a power source, and a heat-transfer plate 34 such as an aluminum-alloy plate sandwiched in between the first and the second covers 11, 12 of the housing and sandwiched in a first layer A and a second layer B (FIG. 1) of the dehydrating agent 2 filled in the interior in the housing 1 for securing the heater 31 on the heat-transfer plate 34, whereby upon supplying of power through the electric plug 33 to actuate the heater 31 to produce heat, the heat from the heater 31 will be radiated towards the first and the second layers A, B of the dehydrating agent 2 through the heat-transfer plate 34 to heat the moisture-saturated dehydrating agent 2 for regenerating the dehydrating agent 2.

The heat-transfer plate 34 is formed with a plurality of heat-dissipating and air-guiding means 35 through the heat-transfer plate 34 to transfer or radiate the heat from the heater 31 towards the dehydrating agent 2 disposed on opposite sides of the plate 34; and also to allow air or moisture-laden air passing through the heat-dissipating and air-guiding means 35 for better ventilation by flowing the air or moisture-laden air through the perforations 121, 111 formed through the first and second covers 11, 12 and the heat-dissipating and air-guiding means 35 formed through the heat-transfer plate 34.

The heat-dissipating and air-guiding means 35 may be a short cylindrical duct as formed in situ in the heat-transfer plate 34, having two effects of the duct 35 as follows:

1. The duct 35 will serve as a "fin" for radiating heat to the dehydrating agent 2 adjacent to the plate 34 for efficiently heating and regenerating the agent 2 by the heater 31.

2. The duct will serve as a well ventilation way of the air or moisture-laden air through each duct 35.

The heat-dissipating and air-guiding means 35 may be simplified to be a fin as directly pressed or formed from the heat-transfer plate 34.

For further simplifying the structure of the heat-dissipating and air-guiding means 35, it may be eliminated in the present invention, just by securing a heat-transfer plate 34 in the housing 1 to transfer the heat from the heater 31 of the heating means 3.

The electric plug 33 of the heating means 3 is pivotally secured in a plug chamber 10 as formed in the second cover 12 of the housing 1, whereby when actuating the plug 33, the plug 33 may be pivotally biased about a pivot 331 to be perpendicular to the housing 1 as dotted line shown in FIG. 1 for power connection for powering the heater 31.

The pads 13 formed on the second cover 12 of the housing 1 will form a ventilation aperture between a supporting surface S and the second cover (or bottom cover) 12 of the housing (FIG. 1) to maintain air ventilation through the perforations formed in the housing 1.

Naturally, the housing 1 as shown in FIG. 1 may be turned for a right angle to erect the housing to allow its side wall 16 to stand on a supporting surface S' (dotted line of FIG. 1). By the way, the two covers 11, 12 are vertically erected to allow an air flow passing through the perforations formed through the covers 11, 12 and the interior in the housing 1 now vertically erected as perpendicular to that (solid line) as shown in FIG. 1.

The shapes and structures of the elements of the present invention are not limited.

The saturation indicator 4 includes: a transparent capsule 40 fixed in the first cover 11 to be visually displayed from the first cover 11, a plurality of ventilation slits (or holes) 41 formed in a bottom wall of the capsule 40 to be fluidically communicated with an interior in the housing 1, and a dehydrating agent 42 made of the moisture-absorbable materials as same as that of the dehydrating agent 2 (e.g., silica gel) filled in the interior in the housing having a color-change indicator (e.g., a cobalt chloride) impregnated in the dehydrating agent 42 in the capsule 40, with the color-change indicator subjected to color change (such as from blue color to red color) when the dehydrating agent 42 is saturated with moisture.

By visually checking the color change through the transparent capsule 40 of the saturation indicator 4, it will remind the user to regenerate the dehydrating agent 2 in the housing 1 by actuating the heater 31 of the heating means 3 in order to regenerate the dehydrating agent ready for next use.

The present invention provides a compact portable dehumidifier which can be regenerated to re-use the dehydrating agent without wasting the agent and without causing problem of environmental protection. By sandwiching the heater in the dehydrating agent, it really greatly minimizes the volume of the dehumidifier and decreases the cost.

The present invention may be modified without departing from the spirit and scope of the present invention.

I claim:

1. A regenerative dehumidifier comprising:

a housing having a plurality of perforations formed therethrough;

a dehydrating agent for absorbing moisture laden in the air and operatively regenerated by heat for vaporizing and removing moisture in said dehydrating agent when saturated with the moisture; said housing including: a first cover, a second cover combined with said first cover for forming the housing for filling the dehydrating agent therein, a plurality of supporting pads formed on the second cover, at least a plug plugged in a plug hole formed in a side portion of the housing, with said plug hole formed for filling the dehydrating agent into the interior of the housing through the plug hole; and a heating means having a heater secured on a heat-transfer plate secured in an interior in said housing; said heating means including: said heater electrically connected to an electric plug connected to a power source, and said heat-transfer plate sandwiched in between a first and a second cover of the housing and sandwiched in a first layer and a second layer of the dehydrating agent as disposed on opposite sides of said heat-transfer plate and filled in the interior in the housing, whereby upon supplying of power through the electric plug to actuate the heater to produce heat, the heat from the heater will be radiated towards the first and the second layers of the dehydrating agent through the heat-transfer plate to heat the moisture-saturated dehydrating agent for regenerating the dehydrating agent;

the improvement which comprises:

said heat-transfer plate having a plurality of short cylindrical ducts formed in situ through the heat-transfer plate to transfer and radiate the heat from the heater towards the dehydrating agent disposed on opposite sides of the plate; and to allow air passing through the short cylindrical ducts for better ventilation by flowing the air through a plurality of perforations formed through the first and second covers and the short cylindrical ducts formed through the heat-transfer plate.

* * * * *